US008846590B2

(12) United States Patent
Castle

(10) Patent No.: US 8,846,590 B2
(45) Date of Patent: Sep. 30, 2014

(54) METHOD FOR LUBRICATING DIAMOND-LIKE CARBON COATED SURFACES

(75) Inventor: Rebecca Castle, Kidlington (GB)

(73) Assignee: Infineum International Limited (GB)

( * ) Notice: Subject to any disclaimer, the term of this patent is extended or adjusted under 35 U.S.C. 154(b) by 1326 days.

(21) Appl. No.: 10/810,044

(22) Filed: Mar. 26, 2004

(65) Prior Publication Data

US 2005/0119136 A1 Jun. 2, 2005

(30) Foreign Application Priority Data

Mar. 26, 2003 (EP) ..... 03251902

(51) Int. Cl.
*C10M 139/00* (2006.01)
*F02B 43/00* (2006.01)
*C10M 135/18* (2006.01)

(52) U.S. Cl.
CPC ..... *C10M 135/18* (2013.01)
USPC ..... 508/363; 508/109; 508/364; 508/365; 123/1 A

(58) Field of Classification Search
USPC ..... 508/363
See application file for complete search history.

(56) References Cited

U.S. PATENT DOCUMENTS

| | | | | |
|---|---|---|---|---|
| 5,771,873 | A | 6/1998 | Potter et al. | 123/668 |
| 6,010,987 | A | 1/2000 | Stiefel et al. | 508/363 |
| 6,063,741 | A * | 5/2000 | Naitoh et al. | 508/365 |
| 6,139,022 | A * | 10/2000 | Iwashita et al. | 277/443 |
| 6,325,385 | B1 * | 12/2001 | Iwashita et al. | 277/442 |
| 6,444,624 | B1 * | 9/2002 | Walker et al. | 508/363 |
| 6,642,188 | B1 * | 11/2003 | Hartley et al. | 508/291 |
| 6,706,672 | B2 * | 3/2004 | Kelley | 508/287 |
| 6,806,242 | B2 | 10/2004 | Shirahama et al. | |
| 6,893,720 | B1 * | 5/2005 | Nakahigashi et al. | 428/408 |
| 7,022,653 | B2 * | 4/2006 | Hartley et al. | 508/364 |
| 7,146,956 | B2 * | 12/2006 | Nomura et al. | 123/90.6 |

FOREIGN PATENT DOCUMENTS

| | | | | |
|---|---|---|---|---|
| EP | 0 811 674 | A1 | 12/1997 | C10M 169/04 |
| WO | WO99/60080 | A1 | 11/1999 | C10M 141/10 |

* cited by examiner

*Primary Examiner* — Ellen McAvoy

(57) ABSTRACT

A method of lubricating a surface coated with a diamond-like carbon film or coating which comprises supplying to said surface a lubricating oil composition comprising an oil of lubricating viscosity and an effective friction reducing amount of an oil soluble organo-molybdenum compound.

8 Claims, No Drawings

METHOD FOR LUBRICATING DIAMOND-LIKE CARBON COATED SURFACES

This invention relates to lubricating oil compositions (also known as lubricants) particularly useful for lubricating surfaces coated with diamond-like carbon (DLC) films or coatings.

Diamond-like carbon hereinafter (DLC), is a known amorphous carbon material usually provided in the form of a film or coating, and so-named because its properties resemble, but do not duplicate, those of diamond. Some of these properties are high hardness (about 3 to about 22 GPa), a low friction coefficient (approximately 0.1) and transparency across a major part of the electromagnetic spectrum. At least some of the carbon atoms in DLC are bonded in chemical structures similar to those of diamond, but without long-range crystal order. The term DLC embraces not only pure carbon material, but also extends to amorphous, hard carbon materials containing up to 50 atomic percent of hydrogen. Such hydrogen-containing DLC materials are also referred to variously as "amorphous hydrogenated carbon", "hydrogenated diamond-like carbon" and "diamond-like hydrocarbon". Without wishing to be bound by any theory, the structure of these hydrogen-containing hard carbon materials may be described as a random covalent network of graphitic-type structures interconnected by $sp^3$ linkages, although such a structure has yet to be universally accepted. In addition DLC may be doped with other elements or combinations of elements. The addition of such elements, e.g. silicon and germanium, can provide or enhance useful material properties such as wear resistance, adhesion, hardness, stress, and oxidation resistance. The term "DLC" as used in this specification, includes amorphous non-hydrogenated hard carbon materials, amorphous hydrogenated hard carbon materials and doped modifications thereof.

Many methods for directly depositing DLC films or coatings are known in the art, including (i) direct ion beam deposition, dual ion beam deposition, glow discharge, radio frequency (RF) plasms, direct current (DC) plasma or microwave plasma deposition from a carbon-containing gas or vapour which can also be mixed with hydrogen and/or inert gas and/or other gases containing doping elements, (ii) electron beam evaporation, ion-assisted evaporation, magnetron sputtering, ion beam sputtering, or ion-assisted sputter deposition from a solid carbon or doped carbon target material, or (iii) combinations of (i) and (ii).

The use of such DLC films in coating the components of internal combustion engines is described, for example, in U.S. Pat. No. 5,771,873. The present invention is based on the discovery that surfaces, such as those of engine components, coated with DLC films or coatings can be effectively lubricated.

In accordance with the present invention there has been discovered a method of lubricating a surface coated with a diamond-like carbon film or coating which comprises supplying to said surface a lubricating oil composition comprising an oil of lubricating viscosity, preferably in a major amount, and an effective friction reducing amount of an oil-soluble organo-molybdenum compound. It has been found that the organo-molybdenum additive will substantially reduce friction on the DLC surfaces to an extent not observed on steel surfaces.

Typically an organo-molybdenum additive is used so as to provide 25 to 1000 ppm (parts per million, by weight), preferably 200 to 750 ppm, of elemental molybdenum in the lubricating oil compositions (as determined by ASTM D5185).

Another aspect of this invention is an internal combustion engine having one or more component parts coated with a diamond-like carbon film or coating, and, contained in a reservoir in the engine, a lubricating oil composition for lubricating said parts comprising an oil of lubricating viscosity, preferably in a major amount, and an effective friction reducing amount of an oil-soluble organo-molybdenum compound. The reservoir in the engine maybe a crankcase sump in four-stroke engines, from where it is distributed around the engine for lubrication. The invention is applicable to two-stroke and four-stroke spark-ignited and compression-ignited engines.

A further aspect of the invention relates to the use of a lubricating oil composition comprising an oil of lubricating viscosity and an effective friction-reducing amount of an oil-soluble organo-molybdenum compound to lubricate a surface coated with a diamond-like carbon film or coating.

The invention also provides the use of an oil-soluble organo-molybdenum compound in a lubricating oil composition to reduce the friction between surfaces, at least one of which, preferably each surface, is coated with a diamond-like carbon film or coating.

The method of this invention is especially applicable to the lubrication of spark-ignited or compression-ignited two-stroke or four-stroke internal combustion engines which have parts or components with DLC films or coatings. Examples of such components include the cam shaft, especially the cam lobes; pistons, especially the piston skirt; cylinder liners; and valves.

As examples of such oil-soluble organo-molybdenum compounds, there may be mentioned dithiocarbamates, dithiophosphates, dithiophosphinates, xanthates, thioxanthates and sulfides of molybdenum and mixtures thereof.

Additionally, the molybdenum compounds may be acidic molybdenum compounds. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formulae $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are dialkyldithiocarbamates of molybdenum.

A further class of organo-molybdenum compounds is represented by the formula:

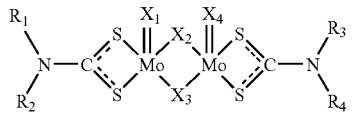

where $R_1$ to $R_4$ independently denote a straight chain, branched chain or aromatic hydrocarbyl group having 1 to 24 carbon atoms; and $X_1$ to $X_4$ independently denote an oxygen atom or a sulfur atom. The four hydrocarbyl groups, $R_1$ to $R_4$, may be identical or different from one another.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. In the instance n is 3, 2 or 1, appropriately charged ionic species is required to confer electrical neutrality to the trinuclear molybdenum compound. The ionic species may be of any valence, for example, monovalent or divalent. Further the ionic species may be negatively charged, i.e. an anionic species, or may be positively charged, i.e. a cationic species or a combination of an anion and a cation. Such terms are known to a skilled person in the art. The ionic species may be present in the compound through covalent bonding, i.e. coordinated to one or more molybdenum atoms in the core, or through electrostatic bonding or interaction as in the case of a counter-ion or through a form of bonding intermediate between covalent and electrostatic bonding. Examples of anionic species include disulfide, hydroxide, an alkoxide, an amide and a thiocyanate or derivate thereof; preferably the anionic species is disulfide ion. Examples of cationic species include an ammonium ion and a metal ion, such as an alkali metal, alkaline earth metal or transition metal, ion, preferably an ammonium ion, such as $[NR_4]^+$ where R is independently H or alkyl group, more preferably R is H, i.e. $[NH_4]^+$. At least 21 total carbon atoms should be present among all the ligands' organo groups, such as at least 25, at least 30, or at least 35 carbon atoms.

The ligands are independently selected from the group of

1 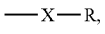

2 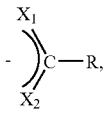

3 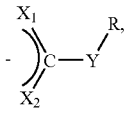

4 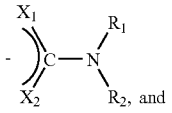

5 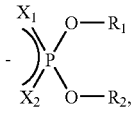

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso and sulfoxy).

3. Hetero substituents, that is substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between 1 to 100, preferably from 1 to 30, and more preferably between 4 to 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as 6 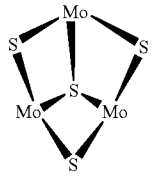

and

7 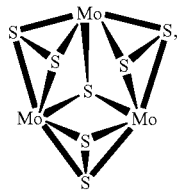

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or oil-dispersible trinuclear molybdenum compounds can be prepared by reacting in the appropriate liquid(s) and/or solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or oil-dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur-abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s) and/or solvent(s) to form an oil-soluble or oil-dispersible trinuclear molybdenum compound. The appropriate liquid and/or solvent may be, for example, aqueous or organic.

A compound's oil solubility or dispersibility may be influenced by the number of carbon atoms in the ligand's organo groups. In the compounds employed in the present invention, at least 21 total carbon atoms should be present among all the ligand's organo groups. Preferably, the ligand source chosen has a sufficient number of carbon atoms in its organo groups to render the compound soluble or dispersible in the lubricating composition.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate and mixtures thereof. Most preferably, the molybdenum compound is present as molybdenum dithiocarbamate. The molybdenum compound is preferably a trinuclear molybdenum compound, such as a trinuclear molybdenum dithiocarbamate.

Natural oils useful as the oil of lubricating viscosity (also known as basestocks) in this invention include animal oils and vegetable oils (e.g. castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification or etherification constitute a class of known synthetic lubricating oils useful as basestocks in this invention. These are exemplified by polyoxyalkylene polymers prepared by polymerization of ethylene oxide or propylene oxide, the alkyl and aryl ethers of these polyoxyalkylene polymers (e.g. methyl-poly isopropylene glycol ether having an average molecular weight of 1000, diphenyl ether of poly-ethylene glycol having a molecular weight of 500-1000, diethyl ether of polypropylene glycol having a molecular weight of 1000-1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils useful in this invention comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (i-butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy) disiloxane, poly(methyl) siloxanes and poly(methylphenyl) siloxanes. Other synthetic lubricating oils include liquid esters of phosphorus-containing acids (e.g. tricresyl phosphate, trioctyl phosphate, diethyl ester of decylphosphonic acid) and polymeric tetrahydrofurans.

Unrefined, refined and rerefined oils can be used in the lubricating oil compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Molybdenum-containing lubricating oil compositions for use in the present invention may also contain any of the conventional additives listed below (including any additional friction modifiers) which are typically used in a minor amount, e.g. such an amount so as to provide their normal attendant functions. Typical amounts for individual components are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1-20 | 1-8 |
| Metal Detergents | 0.1-15 | 0.2-9 |
| Corrosion Inhibitors | 0-5 | 0-1.5 |
| Metal Dihydrocarbyl Dithiophosphate | 0.1-6 | 0.1-4 |
| Anti-oxidant | 0-5 | 0.01-3 |
| Pour Point Depressant | 0.01-5 | 0.01-1.5 |
| Anti-foaming Agent | 0-5 | 0.001-0.15 |
| Supplemental Anti-wear Agents | 0-5 | 0-2 |
| Additional Friction Modifier | 0-5 | 0-1.5 |
| Viscosity Modifier | 0-6 | 0.01-4 |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate (or additive package) that is subsequently blended into basestock to make a finished lubricating oil composition. Use of such concentrates is conventional. The concentrate will typically be formulated to contain the additive(s) in proper amounts to provide the desired concentration in the final lubricating oil composition when the concentrate is combined with a predetermined amount of base oil.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil composition may employ from 2 to 20 mass % and preferably 4 to 15 mass % of the concentrate (or additive package), the remainder being base oil.

Ashless dispersants maintain in suspension oil-insoluble matter resulting from oxidation of the oil during wear or combustion. They are particularly advantageous for preventing precipitation of sludge and formation of varnish, particularly in gasoline engines.

Ashless dispersants comprise an oil-soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil-soluble polymeric hydrocarbon backbone of these dispersants is typically derived from an olefin polymer or polyene, especially polymers comprising a major molar amount (i.e. greater than 50 mole %) of a $C_2$ to $C_{18}$ olefin (e.g. ethylene, propylene, butylene, isobutylene, pentene, octene-1, styrene), and typically a $C_2$ to $C_5$ olefin. The oil-soluble polymeric hydrocarbon backbone may be a homopolymer (e.g. polypropylene or polyisobutylene) or a copolymer of two or more of such olefins (e.g. copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants.

The viscosity modifier (VM) functions to impart high and low temperature operability to a lubricating oil composition. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with a long hydrophobic tail, the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g. carbonate) micelle. Such overbased detergents may have a TBN of 150 or greater, and typically from 250 to 450 or more. Detergents that may be used include oil-soluble neutral and overbased sulfonates, phenates, sulfurized phenates, thiophosphonates, salicylates, and naphthenates and other oil-soluble carboxylates of a metal, particularly the alkali, e.g. sodium, potassium, lithium and magnesium. Preferred are neutral or overbased calcium and magnesium phenates and sulfonates, especially calcium.

Other friction modifiers include oil-soluble amines, amides, imidazolines, amine oxides, amidoamines, nitrites, alkanolamides, alkoxylated amines and ether amines; polyol esters; and esters of polycarboxylic acids.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound may be used but oxides, hydroxides and carbonates are most generally employed. Commercial additives frequently contain an excess of zinc due to use of an excess of the basic zinc compound in the neutralization reaction.

ZDDP provides excellent wear protection at a comparatively low cost and also functions as an antioxidant. However, there is some evidence that phosphorus in lubricant can shorten the effective life of automotive emission catalysts. Accordingly, the lubricating oil compositions of the invention preferably contain no more than 0.8 wt %, such as from 50 ppm to 0.06 wt %, of phosphorus. Independently of the amount of phosphorus, the lubricating oil composition preferably has no more than 0.5 wt %, preferably from 50 ppm to 0.3 wt %, of sulfur, the amounts of sulfur and of phosphorus being measured in accordance with ASTM D5185.

Oxidation inhibitors or antioxidants reduce the tendency of basestocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil-soluble phenates and sulfurized phenates, phosphosulfurized or sulfurized hydrocarbons, phosphorous esters, metal thiocarbamates, oil-soluble copper compound as described in U.S. Pat. No. 4,867,890, and molybdenum-containing compounds.

Rust inhibitors selected from the group consisting of nonionic polyoxyalkylene polyols and esters thereof, polyoxyalkylene phenols, and anionic alkyl sulfonic acids may be used.

Copper- and lead-bearing corrosion inhibitors may be used, but are typically not required in the lubricating oil compositions of the present invention. Typically such compounds are thiadiazole polysulfides containing from 5 to 50 carbon atoms, their derivatives and polymers thereof. Derivatives of 1,3,4-thiadiazoles, such as those described in U.S. Pat. Nos. 2,719,125; 2,719,126; and 3,087,932, are typical. Other similar material are described in U.S. Pat. Nos. 3,821,236; 3,904,537; 4,097,387; 4,107,059; 4,136,043; 4,188,299; and 4,193,882. Other additives are thio and polythio sulfenamides of thiadiazoles such as those described in GB-A-1,560,830. Benzotriazoles derivatives also fall within this class of additive. When these compounds are included in the lubricating oil compositionS, they are preferably present in an amount not exceeding 0.2 wt. % active ingredient.

A small amount of a demulsifying component may be used. A preferred demulsifying component is described in EP-A-330 522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well-known. Typical of those additives, which improve the low temperature fluidity of the fluid, are $C_8$ and $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

In this specification, the term "comprising" (or cognates such as "comprises") means the presence of stated features, integers, steps or components, but does not preclude the presence or addition of one or more other features, integers, steps, components or groups thereof. If the term "comprising" (or cognates) is used herein, the term "consisting essentially of" (and its cognates) is within its scope and is a preferred embodiment; consequently the term "consisting of" (and its cognates) is within the scope of "consisting essentially of" and is a preferred embodiment thereof.

The terms "oil-soluble" or "oil-dispersible" do not mean that the compounds are soluble, dissolvable, miscible or capable of being suspended in the oil in all proportions. They do mean, however, that the compounds are, for instance, soluble or stably dispersible in the oil to an extent sufficient to exert their intended effect in the environment in which the composition is employed. Moreover, the additional incorporation of other additives such as those described above may affect the solubility or dispersibility of the compounds.

The term "major amount" means in excess of 50 mass % of the composition.

The term "minor amount" means less than 50 mass % of the composition.

The invention is further illustrated by the following examples which are not to be considered as limitative of its scope. All percentages are by weight active ingredient content of an additive without regard for carrier or diluent oil.

EXAMPLES

The coefficients of friction for the lubrication of steel on steel surfaces were measured and compared with the coefficients of friction for DLC coated steel surfaces using the same lubricants. The DLC coating is sold as "Dymon-iC" the trademark for a hydrogenated carbon coating supplied by Teer Coatings Ltd. Both types of surfaces were lubricated with:

1. a base oil having a viscosity of 4 $mm^2s^{-1}$ at 100° C.;
2. a composition containing the base oil of (1) and 550 ppm of molybdenum as trinuclear molybdenum dithiocarbamate; and
3. a composition containing the base oil of (1) and 0.3 wt. % of glycerol mono-oleate (GMO), a conventional friction reducing agent used in engine crankcase lubricants.

The results are set forth in Tables 1 and 2 below and were obtained using a Cameron Plint reciprocating pin on plate tribometer, using the following test protocol:

| | |
|---|---|
| Test duration | 8 hours |
| Load (N) | 185 |
| Stroke length (mm) | 10 |
| Frequency (Hz) | 1 |
| Temperature (° C.) | 100 |

TABLE 1

Steel on Steel Lubrication - Co-efficients of Friction

| Time (min) | Baseoil | Baseoil + 550 ppm Mo | Baseoil + 0.3% GMO |
|---|---|---|---|
| 0 | 0.154 | 0.130 | 0.134 |
| 30 | 0.123 | 0.089 | 0.119 |
| 60 | 0.130 | 0.091 | 0.118 |
| 90 | 0.137 | 0.092 | 0.118 |
| 120 | 0.146 | 0.095 | 0.119 |
| 150 | 0.161 | 0.098 | 0.120 |
| 180 | 0.149 | 0.099 | 0.122 |
| 210 | 0.157 | 0.099 | 0.123 |
| 240 | 0.159 | 0.101 | 0.124 |
| 270 | 0.156 | 0.101 | 0.125 |
| 300 | 0.164 | 0.099 | 0.126 |
| 330 | 0.164 | 0.101 | 0.127 |
| 360 | 0.172 | 0.101 | 0.128 |
| 390 | 0.166 | 0.101 | 0.128 |
| 420 | 0.164 | 0.099 | 0.129 |
| 450 | 0.172 | 0.100 | 0.130 |
| 480 | 0.175 | 0.102 | 0.131 |

TABLE 2

DLC on DLC Lubrication - Co-efficients of Friction

| Time (min) | Baseoil | Baseoil + 550 ppm Mo | Baseoil + 0.3% GMO |
|---|---|---|---|
| 0 | 0.111 | 0.113 | 0.111 |
| 30 | 0.118 | 0.080 | 0.115 |
| 60 | 0.119 | 0.076 | 0.109 |

TABLE 2-continued

| DLC on DLC Lubrication - Co-efficients of Friction | | | |
|---|---|---|---|
| Time (min) | Baseoil | Baseoil + 550 ppm Mo | Baseoil + 0.3% GMO |
| 90 | 0.120 | 0.073 | 0.108 |
| 120 | 0.120 | 0.071 | 0.109 |
| 150 | 0.120 | 0.069 | 0.109 |
| 180 | 0.119 | 0.068 | 0.109 |
| 210 | 0.119 | 0.068 | 0.109 |
| 240 | 0.119 | 0.067 | 0.109 |
| 270 | 0.120 | 0.066 | 0.109 |
| 300 | 0.120 | 0.066 | 0.110 |
| 330 | 0.120 | 0.066 | 0.111 |
| 360 | 0.121 | 0.067 | 0.112 |
| 390 | 0.120 | 0.067 | 0.113 |
| 420 | 0.121 | 0.067 | 0.114 |
| 450 | 0.121 | 0.066 | 0.114 |
| 480 | 0.121 | 0.067 | 0.112 |

Table 2 indicates that, in the lubrication of contacting DLC surfaces, the moplybdenum-containing lubricating oil composition is substantially better at increasing friction reduction than the composition containing a conventional friction reducing agent, glycerol mono-oleate.

What is claimed is:

1. A method of lubricating a surface of a metal engine part or component selected from the group consisting of a cam shaft, piston, cylinder liner and valve, which surface is coated with a diamond-like carbon film or coating, which method comprises supplying to said surface a lubricating oil composition comprising an oil of lubricating viscosity and an effective friction reducing amount of an oil-soluble trinuclear molybdenum dithiocarbamate compound.

2. The method of claim 1 wherein the trinuclear molybdenum dithiocarbamate compound is present in the lubricating oil composition in an amount of 25 to 1000 ppm of elemental molybdenum, based on the mass of the lubricating oil composition.

3. The method of claim 1 wherein the lubricating oil composition further comprises one or more additional additives selected from the group consisting of ashless dispersants, metal detergents, corrosion inhibitors, metal dihydrocarbyl dithiophosphates, antioxidants, pour point depressants, antifoaming agents, additional friction modifiers, antiwear agents and viscosity modifiers.

4. The method of claim 1 wherein the coated surface is that of a component part of an internal combustion engine, and the lubricating oil composition is supplied to the engine.

5. An internal combustion engine having one or more metal engine parts or components selected from the group consisting of a cam shaft, piston, cylinder liner and valve coated with a diamond-like carbon film or coating, and, contained in a reservoir of the engine, a lubricating oil composition for lubricating said parts comprising an oil of lubricating viscosity and an effective friction-reducing amount of an oil-soluble trinuclear molybdenum dithiocarbamate compound.

6. The engine of claim 5 which is a spark-ignited or compression-ignited two-stroke or four-stroke internal combustion engine.

7. The engine of claim 5 wherein the trinuclear molybdenum dithiocarbamate compound is present in the lubricating oil composition in an amount of 25 to 1000 ppm of elemental molybdenum, based on the mass of the lubricating oil composition.

8. The engine of claim 5 wherein the lubricating oil composition further comprises on or more additional additives selected from the group consisting of ashless dispersants, metal detergents, corrosion inhibitors, metal dihydrocarbyl dithiophosphates, antioxidants, pour point depressants, antifoaming agents, additional friction modifiers, antiwear agents and viscosity modifiers.

* * * * *